US006948874B2

(12) United States Patent
Roberson

(10) Patent No.: US 6,948,874 B2
(45) Date of Patent: Sep. 27, 2005

(54) APPARATUS FOR ERASING AND CLEANING A MARKER BOARD

(76) Inventor: Orin A. Roberson, 8701 Town Park, #3102, Houston, TX (US) 77036

( * ) Notice: Subject to any disclaimer, the term of this patent is extended or adjusted under 35 U.S.C. 154(b) by 179 days.

(21) Appl. No.: 10/645,113

(22) Filed: Aug. 21, 2003

(65) Prior Publication Data

US 2004/0037612 A1 Feb. 26, 2004

Related U.S. Application Data

(60) Provisional application No. 60/404,881, filed on Aug. 21, 2002.

(51) Int. Cl.[7] ..... A47L 13/26

(52) U.S. Cl. ..... 401/139; 401/137; 401/140; 401/118

(58) Field of Search ..... 401/137–140, 401/119, 118, 195, 187; 222/105, 106, 183

(56) References Cited

U.S. PATENT DOCUMENTS 2,859,463 A * 11/1958 Hirsch ..... 401/139
2,972,768 A * 2/1961 Petion ..... 401/139
3,031,711 A * 5/1962 Herman et al. ..... 401/139
3,160,304 A * 12/1964 Peacock ..... 401/139
3,881,628 A * 5/1975 Brainerd et al. ..... 222/183
5,269,615 A * 12/1993 Lewis, Jr. ..... 401/139
5,299,876 A * 4/1994 Singarella ..... 401/139
5,432,973 A * 7/1995 Wagner et al. ..... 401/195
5,558,453 A * 9/1996 Bell et al. ..... 401/137
5,879,094 A * 3/1999 Lersch et al. ..... 401/139
6,082,595 A * 7/2000 Lin ..... 401/139
6,095,709 A * 8/2000 Armer et al. ..... 401/118
6,457,890 B1 * 10/2002 Kohlruss et al. ..... 401/139

* cited by examiner

*Primary Examiner*—Khoa D. Huynh
(74) *Attorney, Agent, or Firm*—Darcell Walker

(57) ABSTRACT

An apparatus the combines an eraser for a marker board with a container for cleaning the marker board. The apparatus has a bracket design to hold a container of cleaning solution. An opening in the front of the apparatus provides for the insertion of the container of cleaning solution into the bracket. An adhesive means on the bottom side of the bracket enables an eraser to be attached to the bracket.

7 Claims, 7 Drawing Sheets

APPARATUS FOR ERASING AND CLEANING A MARKER BOARD

CROSS-REFERENCE TO RELATED APPLICATIONS

The present application relates to and claims priority from provisional application No. 60/404,881 filed on Aug. 21, 2002, the contents of which are incorporated herein by reference.

FIELD OF THE INVENTION

This invention relates to an apparatus for erasing and cleaning white boards and in particular to an apparatus that combines a whiteboard eraser with a cleaning fluid container. The cleaning-fluid container having cleaning solution used to clean the whiteboard.

BACKGROUND OF THE INVENTION

In recent years, the use of dry erase markers has become increasingly more popular. Most dry erase markers are designed for use on relatively non-porous writing surfaces, such as plastic, mylar, films, porcelain or porcelain-like surfaces and other similar types of surfaces. A very common term used for boards and walls having these types of surfaces is a "whiteboard." For these whiteboards, many types of markers are used for writing thereon. Typically, whiteboard markers have a particular formulation that substantially prevents the ink from permanently adhering to the non-porous writing surface. This ink dries on the surface of the whiteboard leaving a thin film. Previously, the materials used in erasers for erasing the dried ink of a dry erase marker have been similar to conventional chalkboard erasers. The dried film is relatively easily erased with a variety of materials or devices, but most commonly with an eraser made of bristles (many different known types of materials can be used for the bristles), felt, cloth or even the user's finger.

During presentations there is often a need to illustrate some point or some diagram by displaying it on a marker board or whiteboard. Just as with the conventional chalkboard, the information on a marker board is erased at the completion of the meeting or session. On a routine basis, in addition to erasing the board, it is necessary to clean the marker board using a liquid cleaning solution. The container of cleaning solution usually has a sprayer at the end in order to spray the solution onto the board. The eraser is then used to wipe the solution across the board in order to clean to board.

The eraser, cleaning solution and markers are usually stored on a tray attached to the bottom of the marker board. However, in some instances, these items will be moved from their usual storage location or get separated by some other means. The result of the separation is that time is spent trying to locate the eraser or the cleaning solution. There remains a need to a means to keep tract of the eraser and cleaning solution container.

SUMMARY OF THE INVENTION

It is objective of the invention to provide a combination marker board eraser and cleaning fluid container.

It is a second objective of the present invention to provide a more ergonomically efficiently means to erase and write on boards and other writing surfaces by allowing a user to keep track of marker board tools.

It is a third objective of the present invention to provide a bracket device that can be attached to a marker board eraser that can hold a cleaning fluid container.

The present invention is an ergonomically designed apparatus comprising an eraser and spray container attached together with a bracket that results in one device that enables a user to erase and clean with the same apparatus. One embodiment of this invention comprises a spray container and marker board eraser attached together and enables the user to purchase both simultaneously and apply the cleaner fluid efficiently as needed.

A second embodiment comprises a spray container apparatus that can be retrofitted/attached to an existing marker board eraser by a clamping mechanism. This embodiment provides the same efficiently to the user as the first embodiment.

A third embodiment comprises a spray container apparatus that can be retrofitted/attached to an existing marker board eraser via an adhesive material, a screw or some other mechanism and offer and provide the same efficiency to the user as the other previously mentioned embodiments.

The fourth embodiment comprises a spray container for the cleaning solution, the eraser and a compartment on the maker board eraser to contain the markers used to write on the marker board. The marker spray container and the marker board eraser are attached and allow the user to have access to all of the items needed when using a marker board. During a presentation a user can hold the markers in the marker compartment on the eraser device. At the completion of the presentation, the cleaning solution in the container can be applied to the marker board and wiped away in order to remove any tough marks and clean the board. This invention results in less frustration when using the conventional separate spray bottle and eraser.

DETAILED DESCRIPTION OF THE INVENTION

Figure 1:
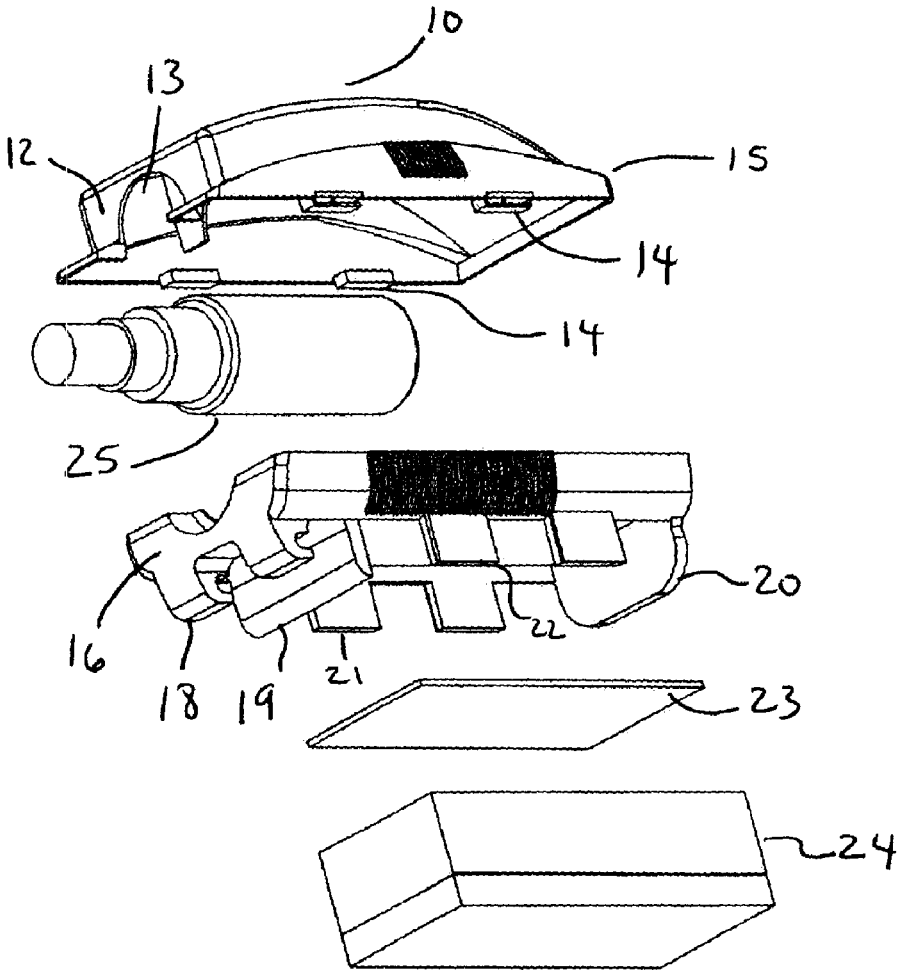
FIG. 1 is an expanded view of the elements in the apparatus of the present invention.

The present invention enables the user of the apparatus to erase and clean a marker board with one apparatus. Referring to FIG. 1, the present invention comprises a bracket that attaches to an eraser and has the capability to hold a cleaner container. The bracket has a generally rectangular shape and comprises a top portion 10 that connects with and attaches to a bottom portion 11. The top bracket section 10 has a front end, a rear end and two sides. The top bracket section can have a curved (convex) shaped surface. The front of the top bracket section 12 has a substantially flat surface with a half circle opening 13 in this flat surface. Along the each side are attachment means 14 that attach the top bracket section to the bottom bracket section 11. Within the top bracket section at a point between the front and rear ends is a first surface section similar to the front end. This section, not shown, also contains the half circle portion that is aligned with the half circle opening 13 in the front end. The half circle in this first section can accommodate a container of cleaning solution. The top bracket section has a rear end 15. This end is substantially flat.

Figure 3:
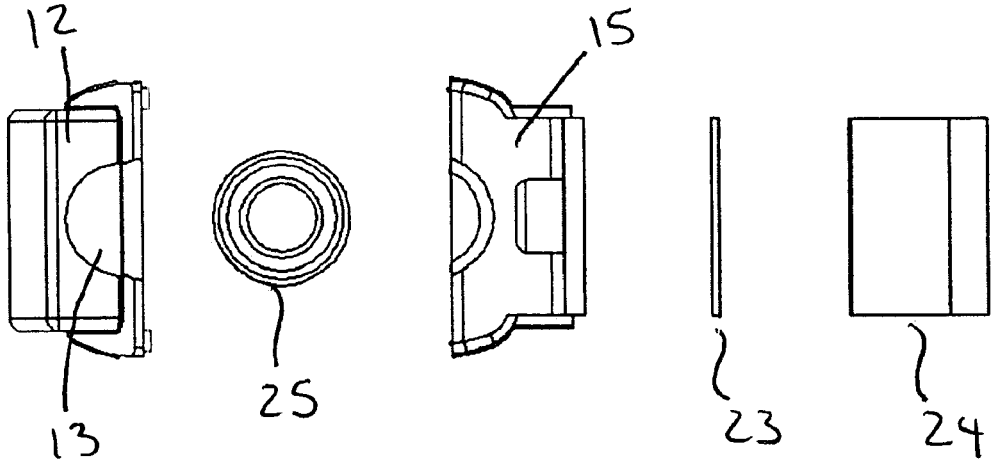
FIG. 3 is an expanded front view of the elements in the apparatus of the present invention.

FIG. 1 also shows a bottom bracket section 11. This section has a rectangular shape similar to the top bracket section. This bottom bracket section has topside that has a concave internal surface. The front end 16 of this section has a half circle in the front-end surface similar to the front end of the top bracket section 12. This half circle is aligned with the half circle in the front end of the top bracket section such that when the top and bottom bracket sections come together a circle is formed by the two half circles (see FIG. 3). The bottom section can also have attachment means on the sides that are aligned with the attachment means of the top bracket section. When the top and bottom sections come together, the attachment means of the two sections engage to cause the sections to attach. FIG. 3 shows the front view of the bracket when the top and bottom sections are attached to each other.

Referring back to FIG. 1, the topside of the bottom bracket section, at a point between the front and rear ends is a first surface section similar to and aligned with the similar first section of the top bracket section. This topside can also contain a second surface between the first surface and the rear end of the bottom section of the bracket. This second surface can be spaced at a distance from the first section such a container of cleaning solution can fit in and extend back toward the rear end of the bracket. As shown in FIG. 1, a container of cleaning solution can fit between the top and bottom sections of the bracket when the top and bottom sections are connected together.

Still referring to FIG. 1, the bottom side of the bottom section contains an extension 18 at the front end of the bottom side. This extension is used to hang the apparatus of the present invention along the tray of a marker board. A second extension 19 is located between first extension 18 and the rear end of the bracket. An extension 20 is located between extension 19 and the rear end of the bracket. The extension 20 is located at a distance from extension 19 such that an eraser of standard size can fit between extensions 19 and 20. Extensions 21 and 22 are also located on both sides of the bottom section. All of the extensions 19, 20, 21 and 22 assist in holding the eraser in a stable position during use. On the bottom side of the bottom bracket, there can be an adhesive means 23 to secure the eraser 24 to the bottom bracket.

Figure 2:
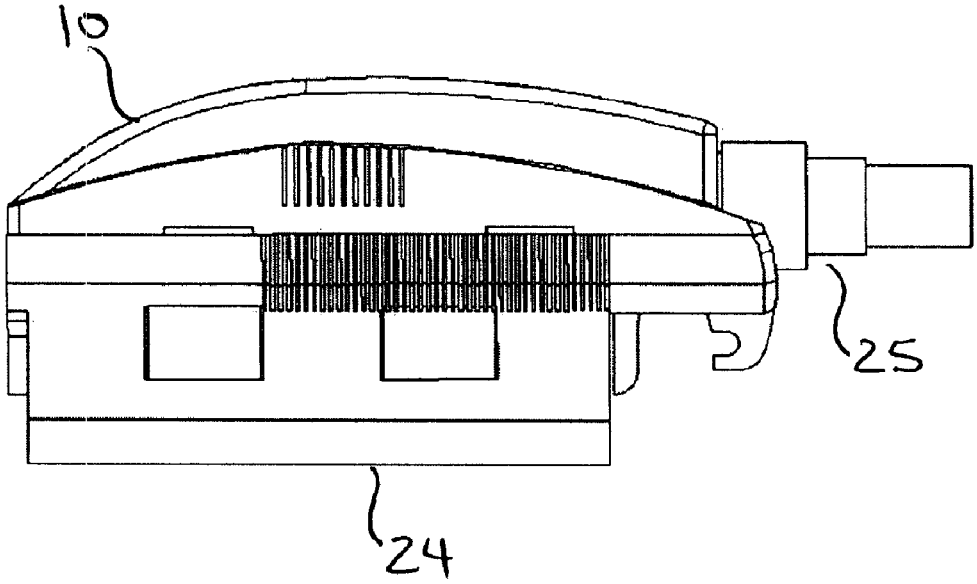
FIG. 2 is a side of the elements in the apparatus of the present invention.

FIG. 2 is a side view of the present invention. In this view, the top and bottom sections of the bracket are attached to each other. The eraser 24 is attached to the bracket 10. A cleaning container 25 containing cleaning fluid extends from the front end of the apparatus.

Figure 4:
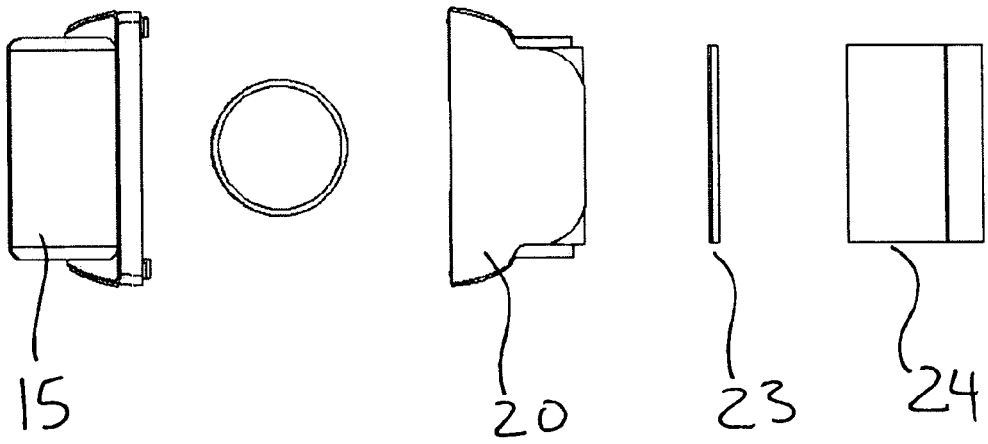
FIG. 4 is an expanded rear view of the elements in the apparatus of the present invention.

FIG. 3 is an expanded front view of the elements in the apparatus of the present invention. Shown in this view are the half circles in the top and bottom sections of the bracket. The cleaning container 25 fits into the circle opening created when the top and bottom sections are attached to each other. FIG. 4 is an expanded rear view of the elements in the apparatus of the present invention.

Figure 5:
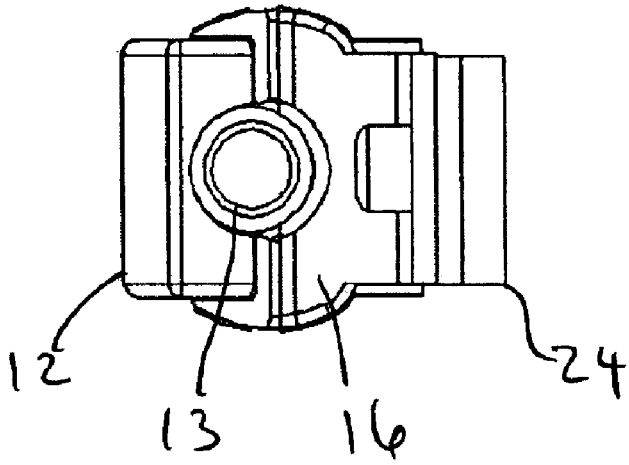
FIG. 5 is a front view of the apparatus of the present invention.
Figure 6:
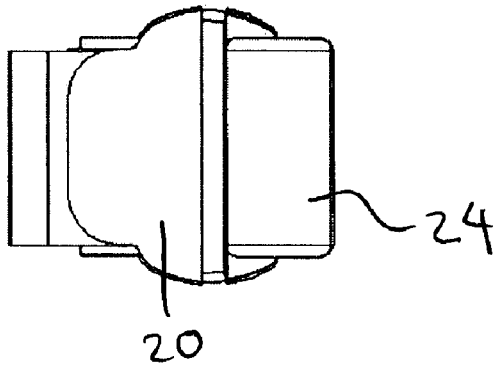
FIG. 6 is a rear view of the apparatus of the present invention.

FIG. 5 is a front view of the apparatus of the present invention. In this view the top and bottom are connected together. FIG. 6 is a rear view of the apparatus of the present invention with the top and bottom sections of the bracket connected.

Figure 7:
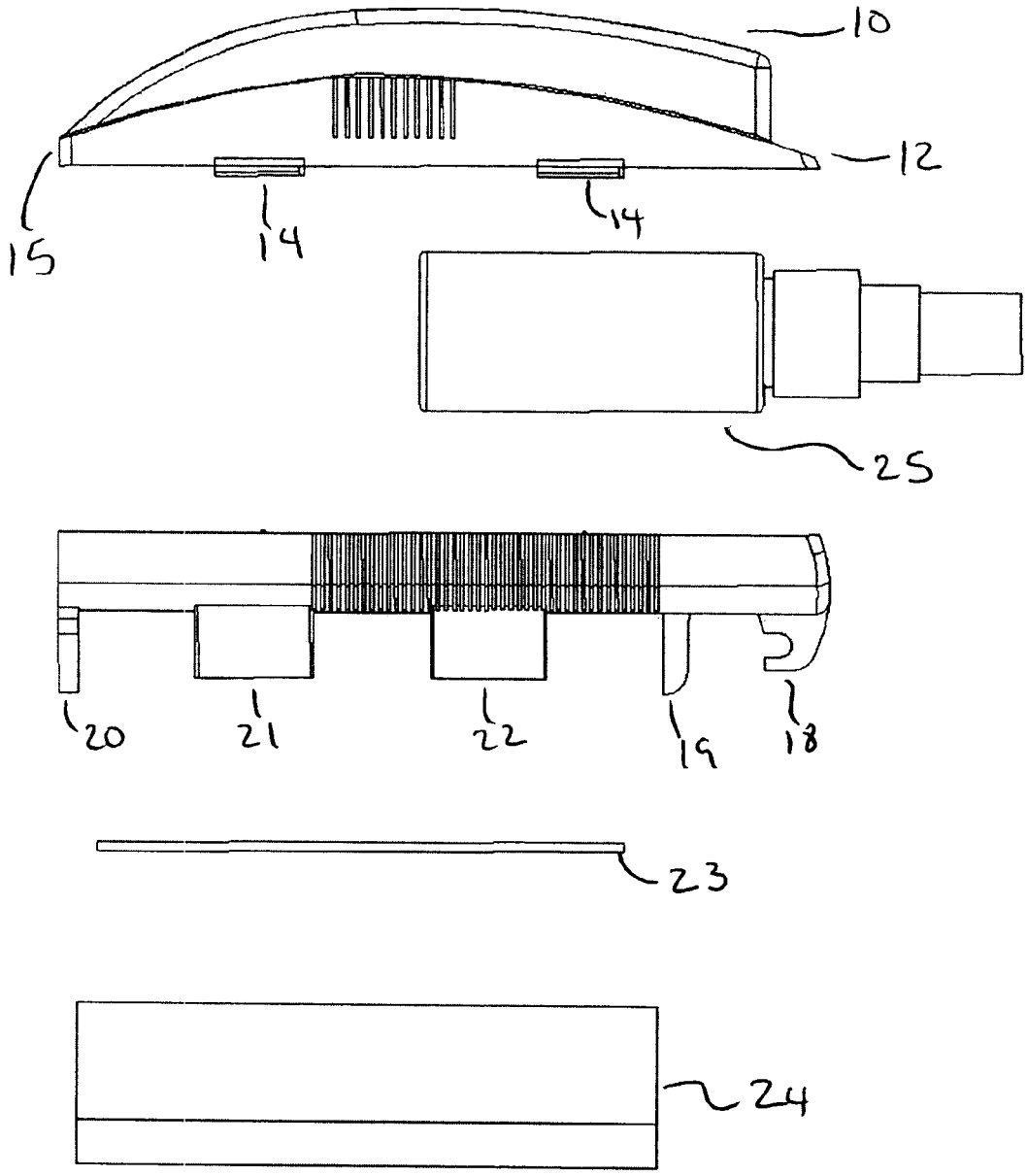
FIG. 7 is an expanded side view of the apparatus of the present invention.

FIG. 7 shows an expanded side view of the invention. This view enables one to see the components as previously described.

Figure 8A:
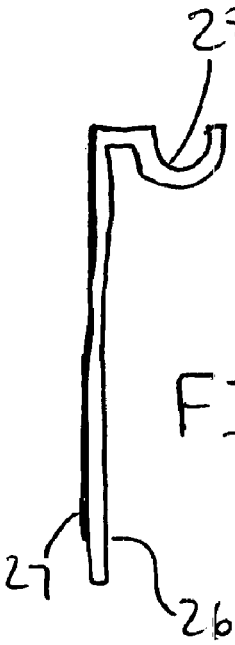
FIG. 8*a* is a side view of a hanging device for the apparatus of the present invention when the apparatus is not in use.
Figure 8B:
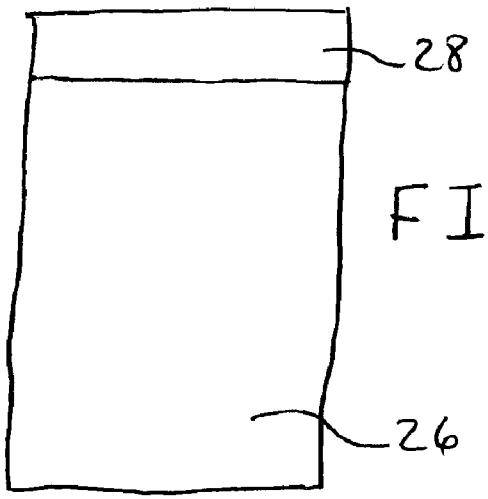
FIG. 8*b* is a front view of the hanging device for the apparatus of the present invention when the apparatus is not in use.

In some cases, the marker board may not have a tray from which to hand the apparatus of the present invention when it is not in use. In those cases, a hanger device as shown in FIGS. 8*a* and 8*b* can be attached to the wall adjacent the marker board. This device comprises flat surface 26 and a hook shaped top end 27. An attaching material 28 affixed to the backside of the device provides a means to attach the device to the wall.

In another embodiment, the bracket 10 can be a piece bracket. In this embodiment the two sections are permanently connected to form this one piece. In addition, the side extensions 21 and 22 can be moveable to accommodate various sizes of erases.

The material used in the preferred embodiment is a plastic type material. The adhesive material can be a type such as Velcro.

When a user has marked on a board and desires to now erase ands clean the board, the user simply uses the eraser to first remove the markings. After the removal of the markings on the board, the user can spray cleaning solution from the container onto the board and use the eraser to remove the cleaning solution and further clean the board. This process only requires the use of the one apparatus of the present invention.

The apparatus of this invention provides significant advantages over the current art. The invention has been described in connection with its preferred embodiments. However, it is not limited thereto. Changes, variations and modifications to the basic design may be made without departing from the inventive concepts in this invention. In addition, these changes, variations and modifications would be obvious to those skilled in the art having the benefit of the foregoing teachings. All such changes, variations and modifications are intended to be within the scope of this invention.

I claim:

1. An apparatus for erasing and cleaning marking boards comprising:

a bracket having a top surface, a bottom surface, a front and a back end, sides connected to the top surface, bottom surface and front and back ends of the bracket, said bracket also having an opening in the front end of the bracket;

a set of extensions attached to said bracket sides;

a first front extension attached to the bottom surface of the bracket at the front end of the bracket, said front extension having a curved shape and used to hang and store the apparatus when the apparatus is not in use;

an extension at the rear end of the bracket and a second front extension, said second front extension being positioned between the first front extension and said rear end extension;

an eraser attached to the bottom, wherein said second front extension and said rear end extension assist in holding said eraser in a stable position during use; and a container having cleaning solution therein, said container being inserted into said bracket through the opening in the front end of the bracket.

2. The apparatus as described in claim 1 further comprising an adhesive material affixed to the bottom side of said bracket, said adhesive material used for attaching the eraser to the bottom of the bracket.

3. The apparatus as described in claim 1 wherein said bracket comprises a top section and a bottom section, said top and bottom section being detachable from each other.

4. The apparatus as described in claim 3 wherein said top and bottom sections each further comprise an internal side, each said internal side having a wall extending from said internal side, said walls containing an approximately half circle opening and being said walls being aligned such that when said top and bottom sections are attached a circle opening is formed from the half circle openings of said walls.

5. A system for erasing and cleaning marking boards comprising;

a bracket having a top surface, a bottom surface, a front and a back end, sides connected to the top surface, bottom surface and front and back ends of the bracket said bracket also having an opening in the front end of the bracket;

a set of extensions attached to said bracket sides;

a first front extension attached to the bottom surface of the bracket at the front end of the bracket, said front extension having a curved shape and used to hang and store the apparatus when the apparatus is not in use;

an extension at the rear end of the bracket and a second front extension, said second front extension being positioned between the first front extension and said rear end extension;

an eraser attached to the bottom, wherein said second front extension and said rear end extension assist in holding said eraser in a stable position during use; a container having cleaning solution therein, said container being inserted into said bracket through the opening in the front end of the bracket; and a hanger in the general location of the marker board for holding the bracket, eraser and container combination when the bracket combination is not in use.

6. The system as described in claim 5 wherein said hanger further comprises a hooked shaped top portion for engaging and holding the bracket combination.

7. The system as described in claim 6 wherein said hanger further comprises an adhesive material to affix the hanger adjacent a marker board.

* * * * *